US007896515B2

(12) United States Patent
Yang

(10) Patent No.: US 7,896,515 B2
(45) Date of Patent: Mar. 1, 2011

(54) DECORATIVE OBJECT CONNECTABLE TO A CONNECTED OBJECT

(75) Inventor: Jung-Chou Yang, Taiping (TW)

(73) Assignees: Jung-Chou Yang, Taiping (TW); Yi-Pin Meng, Taichung (TW); Kun-Lin Yu, Cigu Township (TW)

( * ) Notice: Subject to any disclaimer, the term of this patent is extended or adjusted under 35 U.S.C. 154(b) by 6 days.

(21) Appl. No.: 12/180,150

(22) Filed: Jul. 25, 2008

(65) Prior Publication Data

US 2010/0027252 A1 Feb. 4, 2010

Related U.S. Application Data

(63) Continuation-in-part of application No. 11/905,875, filed on Oct. 5, 2007, now abandoned.

(51) Int. Cl.
*F21V 21/00* (2006.01)

(52) U.S. Cl. ..... 362/103; 362/276; 362/806

(58) Field of Classification Search ..... 362/103, 362/104, 105, 106, 108, 189, 196, 200, 201, 362/276, 802, 806
See application file for complete search history.

(56) References Cited

U.S. PATENT DOCUMENTS 4,605,882 A * 8/1986 DeLuca ..... 362/104
6,474,830 B1 * 11/2002 Hansen ..... 362/103
6,902,304 B2 * 6/2005 Yang ..... 362/806
7,390,103 B2 * 6/2008 Chang ..... 362/806
2004/0032734 A1 * 2/2004 Chen ..... 362/189
2008/0253108 A1 * 10/2008 Ellenburg et al. ..... 362/103

* cited by examiner

*Primary Examiner*—Y My Quach Lee
(74) *Attorney, Agent, or Firm*—Wang Law Firm; Li K. Wang

(57) ABSTRACT

A decorative object connectable to a connected object includes a connecting member, a stylish decorative member fixed to an end of the connecting member, and a light emitting device installed in the stylish decorative member. The stylish decorative member has a closed space inside, a top surface and a bottom surface, and the bottom surface is connected to the connecting member. The stylish decorative member further has a contact portion at an inner side of the top of the decorative object. The power of the light emitting device is supplied by at least one battery. The light emitting device includes a light emitting element and an ON/OFF switch installed at a position corresponding to the contact portion. If an external force is exerted onto the decorative object, the contact portion will be in contact with the ON/OFF switch to turn on or off the power of the light emitting device.

2 Claims, 4 Drawing Sheets

DECORATIVE OBJECT CONNECTABLE TO A CONNECTED OBJECT

This is a Continuation-In-Part application of applicant's former patent application with application Ser. No. 11/905,875 Oct. 5, 2007 now abandoned.

BACKGROUND OF THE INVENTION

1. Field of the Invention

The present invention relates to a decorative object connectable to a connected object, and more particularly to a decorative object that can be installed to and removed from the connected object.

2. Description of the Related Art

In general, a traditional decorative object is installed and fixed onto a connected object such as a shoe, a hat, a backpack, or a cloth for the decoration purpose. Although these decorative objects can provide a decorating effect, they also give rise to the following problems:

1. The decorative object cannot be replaced. Most of the traditional decorative objects installed on a connected object are fixed, and thus they cannot be replaced. For users who want to have new configurations or designs from time to time, the decorative object cannot meet this requirement of changing the connected object.

2. The decorative object does not provide a warning effect. In general, the decorative object installed on a connected object is used for decoration only, and usually does not provide any lighting effect, and thus the decorative object of this sort does not give any warning effect to users who walk at nighttime.

3. The decorative object does not have much fun. Since the traditional decorative object cannot be replaced, and does not come with a lighting effect, therefore its use is relatively monotonous.

SUMMARY OF THE INVENTION

It is a primary objective of the present invention to overcome the aforementioned shortcoming by providing a decorative object connectable to a connected object, and the decorative object can be installed onto a connected object for decoration or removed from the connected object to change for a different decorative object easily.

A secondary objective of the present invention is to provide a decorative object connectable to a connected object that gives a long life of battery.

To achieve the forgoing objectives, the present invention provides a decorative object connectable to a connected object, and the decorative object comprises a connecting member coupled to a connected object, a stylish decorative member fixed to an end of the connecting member, and a light emitting device installed inside the decorative object.

A fixing portion is disposed at an end of the connecting member, and a stop portion is disposed at another end of the fixing portion, and a connecting portion of the connecting member is disposed between the fixing portion and the stop portion, wherein the external diameter of the connecting portion is smaller than the external diameters of the fixing portion and the stop portion for forming a first stop surface at the joint of the fixing portion and the connecting portion, and a second stop surface at the joint of the stop portion and the connecting portion.

The stylish decorative member has a 3D appearance, and includes a closed space inside the stylish decorative member, a top surface, a bottom surface coupled to a fixing portion of the connecting member, and a contact portion disposed on an internal side of the top surface of the stylish decorative member.

At least one battery supplies electric power to the light emitting device. The light emitting device includes a light emitting element and an ON/OFF switch, and the ON/OFF switch is installed corresponding to the contact portion, such that when an external force is exerted onto the stylish decorative member, the contact portion to is forced to be in contact with the ON/OFF switch to turn on or off the power of the light emitting device.

DETAILED DESCRIPTION OF THE PREFERRED EMBODIMENTS

Figure 1:
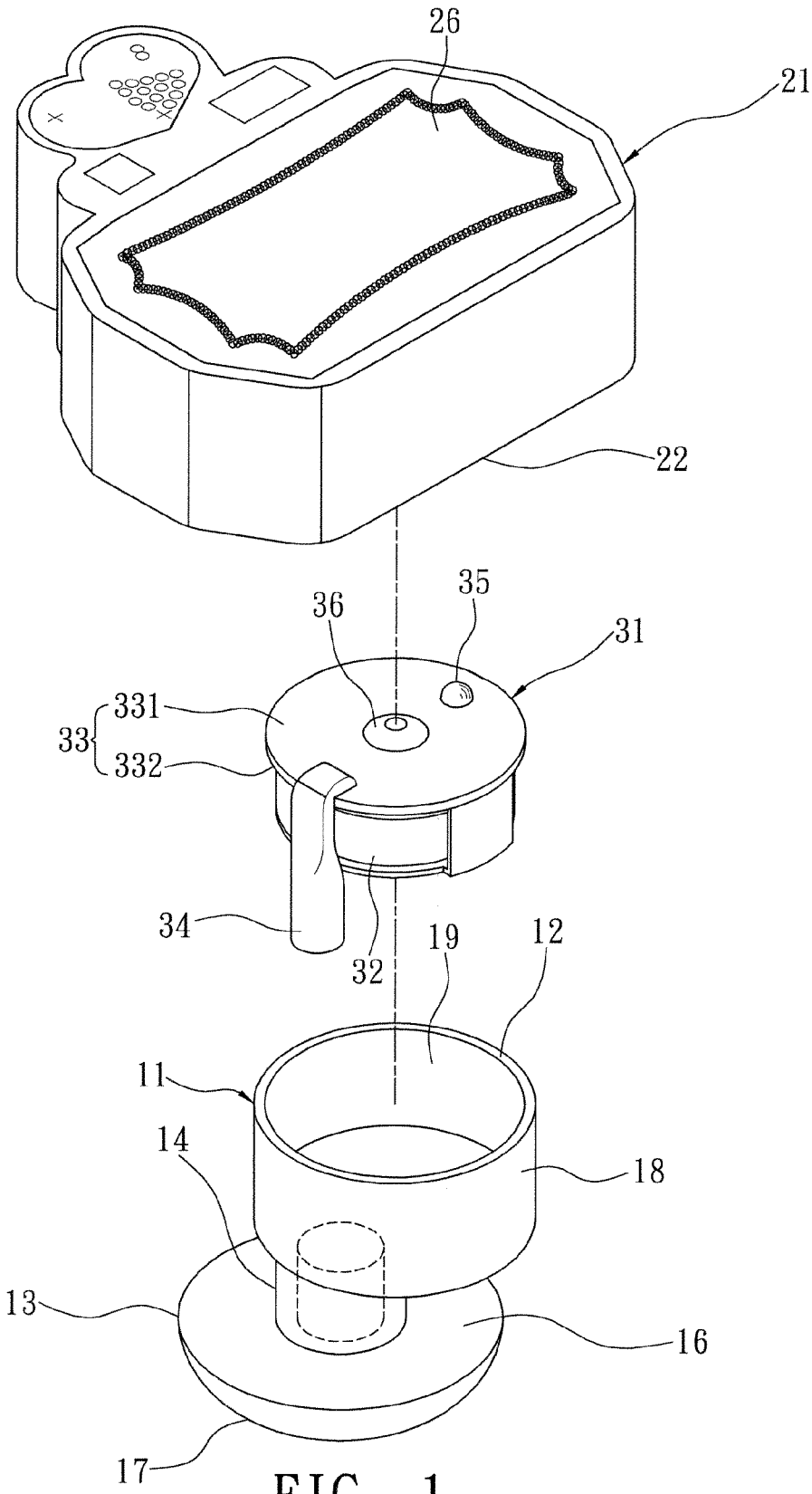
FIG. 1 is a perspective view of the present invention.
Figure 2:
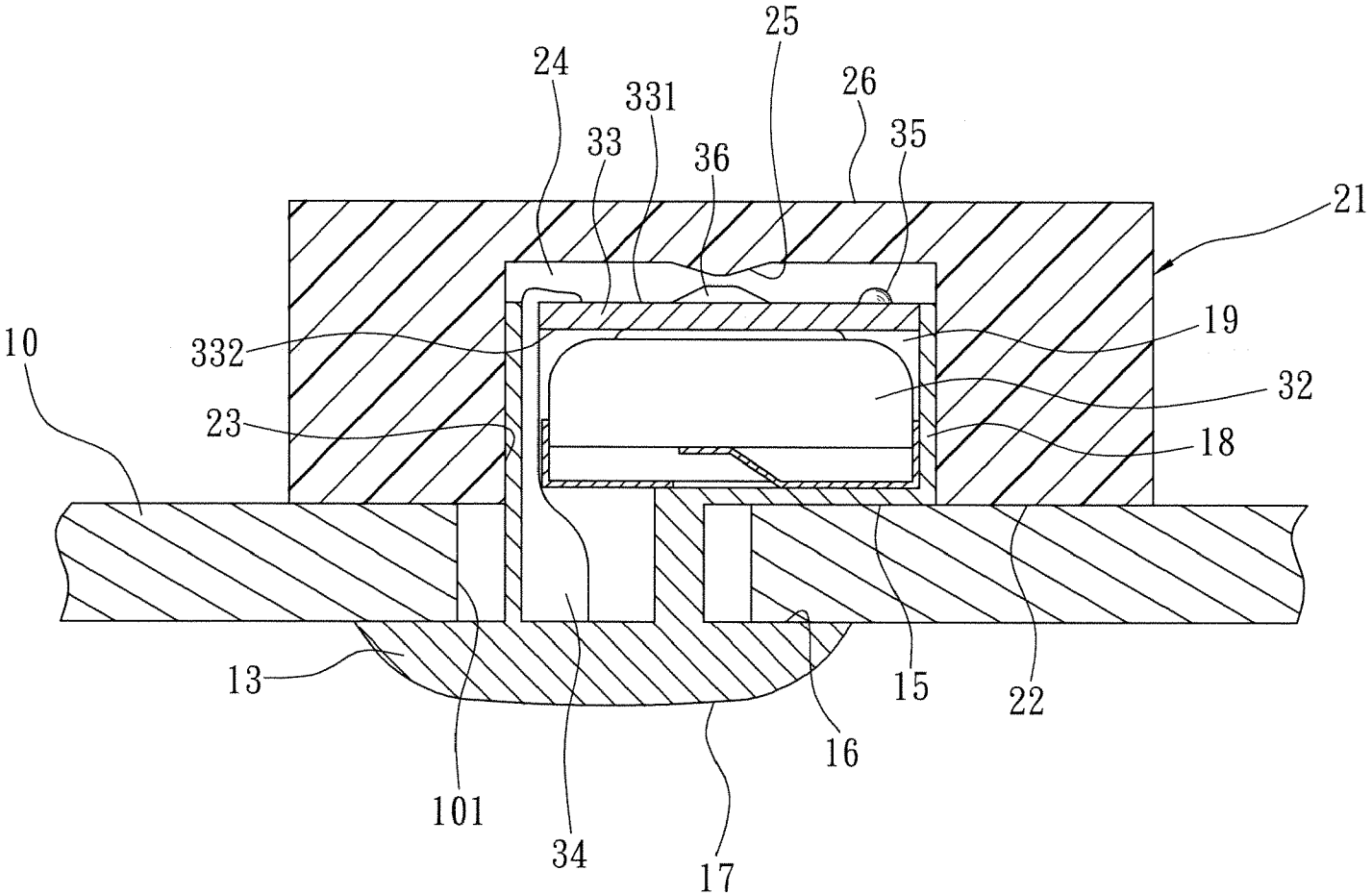
FIG. 2 is a perspective view of an assembly of the present invention.

With reference to FIGS. 1 and 2, a decorative object connectable to a connected object in accordance with a preferred embodiment of the present invention comprises a connecting member 11 coupled to the connected object 10, a stylish decorative member 21 fixed to an end of the connecting member 11, and a light emitting device 31 installed in the stylish decorative member 21.

The connecting member 11 includes a fixing portion 12 at an end of the connecting member 11, and the connecting member 11 includes a stop portion 13 at another end of the fixing portion 12, and a connecting portion 14 between the fixing portion 12 and the stop portion 13, wherein the connecting portion 14 is substantially a hollow pillar, and the external diameter of the connecting portion 14 is smaller than the external diameters of the fixing portion 12 and the stop portion 13 for forming a first stop surface 15 at the joint position of the fixing portion 12 and the connecting portion 14, and a second stop surface 16 at the joint position of the stop portion 13 and the connecting portion 14. The stop portion 13 is a sheet body, and the stop portion 13 corresponding to a lateral surface of the second stop surface 16 is an arc surface 17, and a wall 18 is extended upward around the periphery of the fixing portion 12 of the connecting member 11 to form a hole 19 inside the wall 18.

The stylish decorative member 21 is made of a soft material, and in a 3D transparent form, and the stylish decorative member 21 includes a closed space 24 therein, a top surface 26, a bottom surface 22, and an opening on the bottom surface 22 provided for embedding the wall 18 of the fixing portion 12 of the connecting member 11 into the stylish decorative member 21 from the opening 23, such that the stylish decorative member 21 is coupled to the fixing portion 12 of the connecting member 11, and a contact portion 25 substantially protruded downward is disposed on the top surface 26 of the stylish decorative member 21 and corresponding to an internal side of the wall 18.

The light emitting device 31 is installed in hole 19 of the connecting member 11, such that the light emitting device 31 is situated inside the stylish decorative member 21. At least one battery 32 supplies electric power to the light emitting device 31. The light emitting device 31 comprises a circuit control board 33, a vibration sensor 34, a light emitting element 35 and an ON/OFF switch 36, and the circuit control board 33 includes a top surface 331 and a bottom surface 332, and the light emitting element 35 and the ON/OFF switch 36 are installed at the top surface 331 of the circuit control board 33, and the ON/OFF switch 36 is installed corresponding to the contact portion 25 of the closed space 24, and the light emitting element 35 is controlled by the vibration sensor 34 to produce a light source. The battery 32 is installed at the bottom surface 332 of the circuit control board 33 and situated at the bottom of the hole 19. The vibration sensor 34 is installed in the 25 connecting portion 14 to save space on the top surface 331 of the circuit control board 33.

During use, the connecting member 11 is connected to a connected object 10, and the connected object 10 is a shoe, a hat, a backpack or a cloth made of a soft material, and the connected object 10 includes a plurality of connecting holes 101 thereon, such that the stop portion 13 of the connecting member 11 can be passed through the connecting hole 101 (which is made of a soft material, and can be spread open slightly by its expandability) of the connected object 10, so that the first stop surface 15 of the fixing portion 12 of the connecting member 11 and the second stop surface 16 of the stop portion 13 are blocked by both sides of the connecting hole 101, and the connecting member 11 can be positioned onto the connected object 10 successfully. The stylish decorative member 21 is exposed from the surface of the connected object 10 to enhance the decorating effect, and several different shaped stylish decorative members 21 can be prepared for a decorative object and connected to the connected object 10 according to personal preference and the selected decorative object to give a better decorating effect. While a user is walking, the light emitting device 31 in the stylish decorative member 21 is vibrated, and a vibration sensor 34 of the light emitting device 31 detects the vibration to control the light emitting element 35 to blink and emit light for a better decorating effect of the decorative object as well as serving as a warning lamp for users who are walking at nighttime. The invention is practical and has fun in use. If a user needs to remove or change the decorative object on the connected object 10, the user simply needs to separate the stop portion 13 of the connecting member 11 from the connecting hole 101 of the connected object 10 to remove the decorative object quickly or change for another decorative object with a different shaped stylish decorative member 21.

Figure 3:
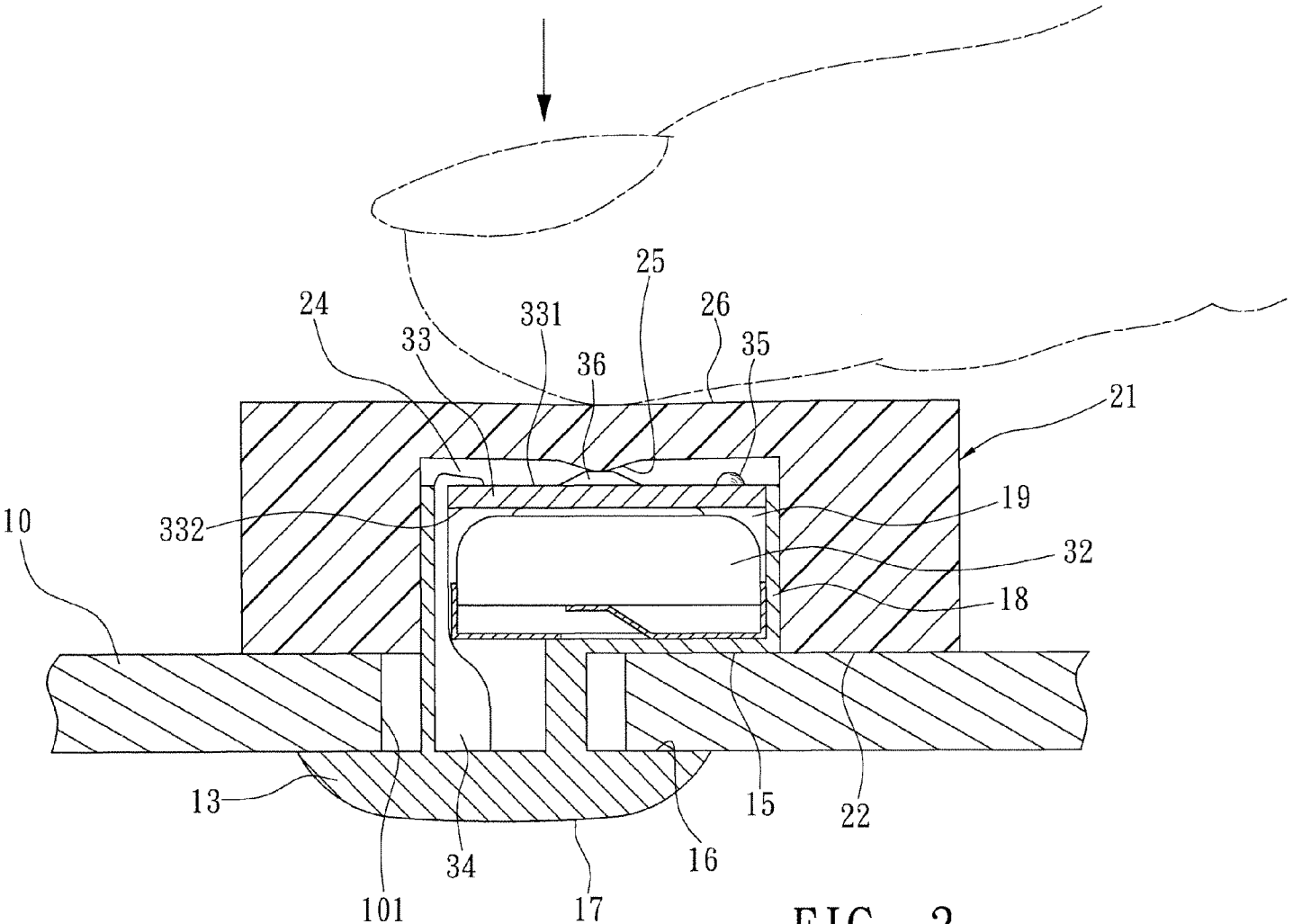
FIG. 3 is a schematic view of a using status showing that a force is exerted onto the stylish decorative member to contact the contact portion with the ON/OFF switch in accordance with the present invention.
Figure 4:
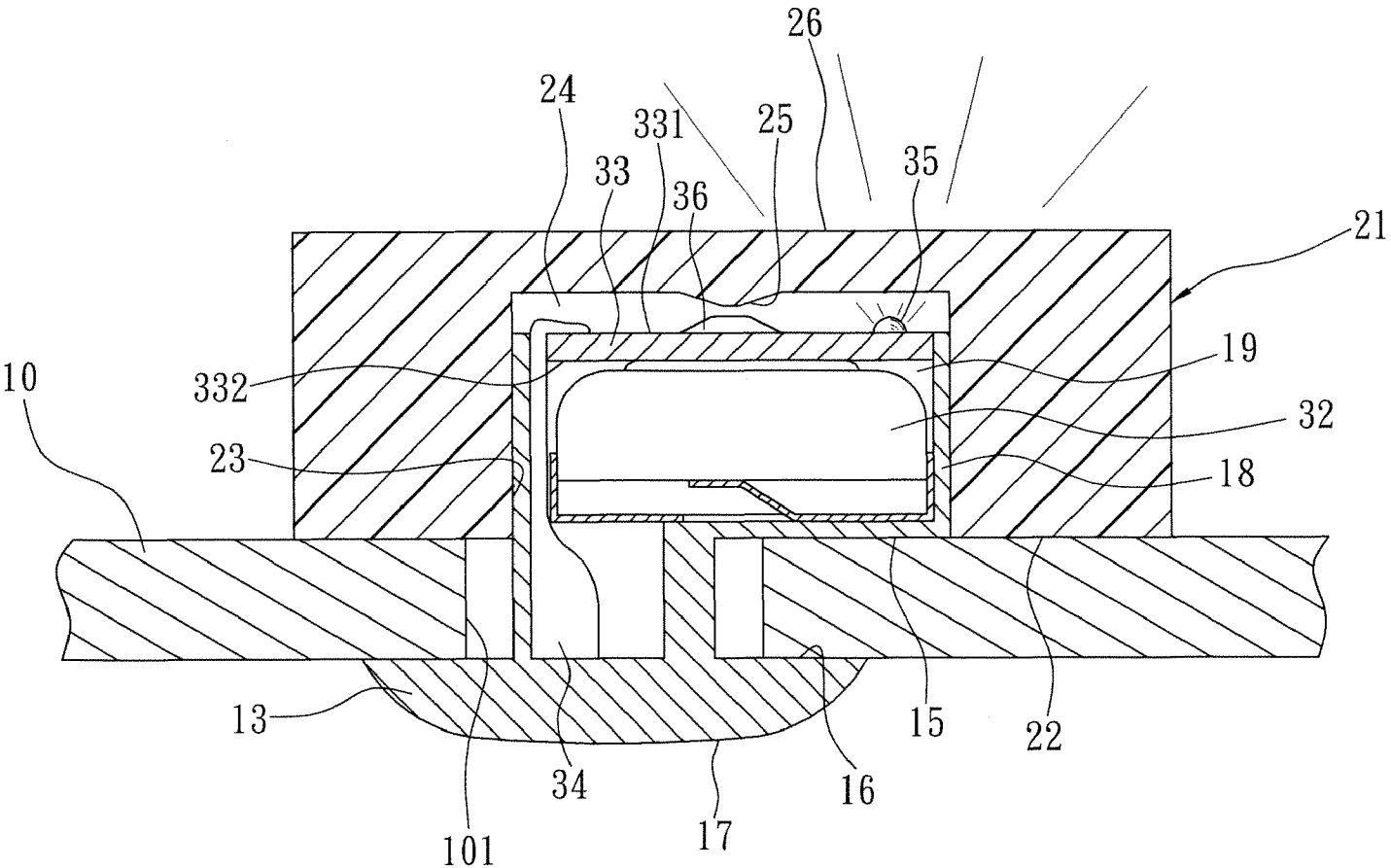
FIG. 4 is a schematic view of a using status showing that when the vibration sensor detects a vibration, the light emitting element blinks and emits light in accordance with the present invention.

With reference to FIG. 3, if a user wants to turn on the power of the light emitting device 31, the user simply needs to apply an external force onto the top surface 26 of the stylish decorative member 21 to force the contact portion 25 of the stylish decorative member 21 to be in contact with the ON/OFF switch 36, and turn on the power of the light emitting device 31, since the contact portion 25 is extended in the direction towards the ON/OFF switch 36 and substantially in a protruding form. In FIG. 4, if the vibration sensor 34 detects a vibration, the light emitting element 35 is controlled to blink and emit light. Since the light emitting element 35 of the light emitting device 31 is installed inside the stylish decorative member 21 and the stylish decorative member 21 is transparent, the emission of a light source generated by the light emitting element 35 of the light emitting device 31 can be emitted.

With the design of the ON/OFF switch 36 and the contact portion 25, the present invention allows users to select an ON/OFF state of the battery 32, so that the power of the light emitting device 31 can be turned off during transportations or a selling process to extend the life of the battery 32 effectively.

In summation of the description above, the present invention has the following advantages. The connected object 10 of the invention can be installed to or removed from the decorative object easily and thus allowing users to make changes for the decoration purpose to give more fun to the design of the light emitting device 31, as well as providing a warning lamp for users who walk at nighttime. The present invention allows users to select the ON/OFF state of the battery 32, so as to extend the life of the battery 32 effectively.

What is claimed is:

1. A decorative object connectable to a connected object comprising a connecting member coupled to the connected object, a decorative member removably fixed at an end of the connecting member, the decorative member having a contact portion protruding from the decorative member, a light emitting device including a light emitting element and installed inside the decorative object, a vibrating sensor connected to the light emitting device, an ON/OFF inside the decorative object and connected to the light emitting device, the connecting member including a fixing portion, a connection portion connected at one end to the fixing portion and a stop portion connected to other end of the connection portion, the connection portion and the stop portion defining a space receiving the vibrating sensor extending from the light emitting device, the connection portion connected off center to the fixing portion, wherein the decorative member is removably placed on the fixing portion, the light emitting device is placed inside the fixing portion and on top of the connection portion, the contact portion activates the ON/OFF switch, and when the ON/OFF switch is activated the vibrating sensor controls the light emitting device.

2. The decorative object connectable to a connected object of claim 1, wherein the contact portion is extended towards the ON/OFF switch and substantially in a protruding form.

* * * * *